US006569818B2

(12) United States Patent
Nakazato et al.

(10) Patent No.: US 6,569,818 B2
(45) Date of Patent: May 27, 2003

(54) LUBRICATING OIL COMPOSITION

(75) Inventors: Morikuni Nakazato, Shizuoka (JP); Shigeru Iwamoto, Shizuoka (JP); Satoshi Hirano, Shizuoka (JP)

(73) Assignee: Chevron Oronite Company, LLC, San Ramon, CA (US)

( * ) Notice: Subject to any disclaimer, the term of this patent is extended or adjusted under 35 U.S.C. 154(b) by 0 days.

(21) Appl. No.: 09/870,092

(22) Filed: May 30, 2001

(65) Prior Publication Data

US 2002/0019320 A1 Feb. 14, 2002

(30) Foreign Application Priority Data

Jun. 2, 2000 (JP) ..... 2000-166774

(51) Int. Cl.[7] ..... C10M 141/02; C10M 141/01

(52) U.S. Cl. ..... 508/185; 508/291; 508/375; 508/378; 508/460; 508/574

(58) Field of Search ..... 508/291, 185, 508/375, 378, 460, 574

(56) References Cited

U.S. PATENT DOCUMENTS

| | | | | |
|---|---|---|---|---|
| 5,102,566 A | | 4/1992 | Fetterman et al. | 252/32.7 E |
| 5,569,405 A | * | 10/1996 | Nakazato et al. | 508/185 |
| 5,629,272 A | * | 5/1997 | Nakazato et al. | 508/185 |

* cited by examiner

*Primary Examiner*—Jacqueline V. Howard
(74) *Attorney, Agent, or Firm*—S. G. K. Lee

(57) ABSTRACT

A lubricating oil composition having a low P content of 0.01 to 0.1 wt. %, and a sulfated ash of 0.1 to 1 wt. %, which is composed of a) a major amount of mineral base oil having a low S content of at most 0.1 wt. %; b) an ashless alkenyl or alkyl-succinimide dispersant; c) a metal-containing detergent (non-sulfurized alkali metal or alkaline earth metal salt of an alkylsalicylic acid and/or non-sulfurized alkali metal or alkaline earth metal salt of an alkylphenol derivative having a Mannich base structure); d) Zn-DTP; e) an oxidation inhibitor (phenol compound and/or amine compound) and wherein the sulfur content is 0.01 to 0.3 wt %. The lubricating oil composition shows good high temperature detergency notwithstanding its low S, P, and sulfated ash content, and is favorably employable in diesel engines using fuel of an extremely low sulfur content.

19 Claims, No Drawings

LUBRICATING OIL COMPOSITION

This application claims priority from Japanese Patent Application Number 2000-166774, filed Jun. 2, 2000.

The present invention relates to a lubricating oil composition favorably employable for lubricating internal combustion engines such as diesel engines, gasoline engines, and gas engines. In particular, the invention relates to a lubricating oil composition having a low sulfated ash content, a low phosphorus content, and a low sulfur content, while showing good detergency at high temperatures.

BACKGROUND OF THE INVENTION

Diesel internal combustion engines mounted on motor-driven vehicles, constructions machines and power generators are generally driven using gas oil or heavy oil (which is a fuel having a sulfur content of approximately 0.05 wt. % or more). Most lubricating oils for the diesel engines have a sulfated ash content of approx. 1.3 to 2 wt. %, a sulfur content of approx. 0.3 to 0.7 wt. %, a phosphorus content of approx. 0.1 to 0.13 wt. %, and a chlorine content of 50 to 100 ppm (wt.) or more.

As for internal combustion engine-mounted vehicles, particularly, diesel engine-mounted vehicles, it is required to find ways of meeting problems to obviate environmental pollution caused by the exhaust gas components such as particulate and nitrous oxides ($NO_x$). For obviating such environmental pollution, it is proposed to mount exhaust gas-clearing devices containing a particulate filter and oxidizing catalysts and/or $NO_x$ reducing catalysts on the vehicles. The combination of the particulate filter and oxidizing catalysts can trap the soot produced and then oxidize and burn the trapped soot. However, metal oxides, sulfates and carboxylates produced by burning of conventional lubricating oil are apt to plug the filter.

Sulfur contained in the fuel is also converted to sulfuric acid and sulfates which emigrate into exhaust gas. Sulfuric acid and sulfate lower activity of the oxidizing catalysts and/or $NO_x$ reducing catalysts in the exhaust gas-cleaning device. In turn, the sulfur content of fuel should be decreased. Accordingly, it is expected that requirements for decreasing the sulfur content of diesel fuel from the present value of approx. 0.05 wt. % to 0.01 wt. % or lower, and perhaps even further to approx. 0.001 wt. % or lower may be required.

As the sulfur content of fuel is decreased, the content of metal-containing detergent (which functions to neutralize the produced sulfuric acid) in the lubricating oil will also be decreased. The lubricating oil is employed for lubricating the engine parts, but a portion of the lubricating oil is burnt and emigrates into the exhaust gas. Therefore, the decrease in content of the metal-containing detergent, which means decrease of a metal content and a sulfur content, is favorable for decreasing environmental pollution. Moreover, it is preferred to decrease the phosphorus content in the lubricating oil so as to keep the oxidizing catalyst from deterioration. The content of chlorine in the lubricating oil should also be as low as possible, so as to decrease production of dioxins.

Japanese Patent No. 2,922,675 describes an ashless lubricating oil composition favorably employable for diesel engines in combination with fuels of a low sulfur content, which contains specific amounts of an alkylester of (3,5-di-t-butyl-4-hydroxyphenol)carboxylic acid, an ashless succinimide type dispersant, and an ashless amine type or phenol type oxidation inhibitor.

U.S. Pat. No. 5,102,566 describes a low sulfated ash lubricating oil composition which comprises a base oil, at least about 2 wt. % of an ashless nitrogen- or ester-containing dispersant, an oil-soluble antioxidant material, and an oil soluble dihydrocarbyl dithiophosphate anti-wear material, and which has a total sulfated ash (SASH) level of 0.01 to 0.6 wt. % and a weight ratio of SASH to dispersant in the range of 0.01:1 to 0.2:2.

Japanese Patent Provisional Publication No. 8-48989 describes a lubricating oil composition which has a low sulfated ash content and does not disturb functions of particulate traps and oxidizing catalysts, but shows good stability at high temperatures so that it can meet the anticipated exhaust gas regulations. The disclosed lubricating oil composition comprises at least 5 wt. % of a boron-containing ashless dispersant, 0.05 to 0.15 wt. % (in terms of phosphorus content) of zinc thiophosphate, and optionally 0.01 to 2 wt. % of an ashless oxidation inhibitor, under such conditions that the boron content in the composition is at least 0.1 wt. %, the boron content/phosphorus content ratio is at least 0.8, and the sulfated ash content is at most 1.0 wt. %.

SUMMARY OF THE INVENTION

The present invention provides a lubricating oil composition which has a low sulfur content, a low phosphorus content and a low sulfated ash content, and does not disturb functions of particulate traps and oxidizing catalysts and/or $NO_x$ reducing catalysts, while having stability at high temperatures so that it can meet the anticipated exhaust gas regulations.

It is well known to those skilled in the art that decreases of the sulfur content, phosphorus content, and sulfated ash content in the lubricating oil composition result in lowering of high temperature stability of the lubricating oil composition.

It has now been discovered that the lowering of the high temperature stability of the lubricating oil composition by the decreases of the sulfur content, phosphorus content, and sulfated ash content can be compensated using a small amount of a metal-containing detergent having a certain amount of soap content, namely, a content of an organic acid metal salt component is contained, in combination with an ashless dispersant, zinc dialkyldithiophosphate, and an oxidation inhibitor.

In its broadest aspect, the present invention resides in a lubricating oil composition having a sulfur content of 0.01 to 0.3 wt. % and a phosphorus content of 0.01 to 0.1 wt. %, and giving a sulfated ash in the range of 0.1 to 1 wt. %, which comprises a) a major amount of a mineral base oil having a sulfur content of at most 0.1 wt. %;

b) an ashless dispersant comprising an alkenyl- or alkyl-succinimide or a derivative thereof in an amount of 0.01 to 0.3 wt. % in terms of a nitrogen atom content;

c) a metal-containing detergent containing an organic acid metal salt which is selected from the group consisting of a non-sulfurized alkali metal or alkaline earth metal salt of an alkylsalicylic acid having a TBN of 10 to 350 mg·KOH/g and a non-sulfurized alkali metal or alkaline earth metal salt of an alkylphenol derivative having a Mannich base structure, in an amount of 0.1 to 1 wt. % in terms of a sulfated ash content;

d) a zinc dialkyldithiophosphate in an amount of 0.01 to 0.1 wt. % in terms of a phosphorus content; and e) an oxidation inhibitor selected from the group consisting of a phenol compound and an amine compound in an amount of 0.01 to 5 wt. %.

The lubricating oil composition of the present invention preferably has a sulfur content of 0.01 to 0.15 wt. %, a phosphorus content of 0.01 to 0.06 wt. %, and a chlorine content of at most 40 ppm (more preferably at most 30 ppm).

The ashless dispersant employed in the lubricating oil composition of the present invention preferably is a succinimide or a derivative thereof which is obtained by the reaction of a polybutenylsuccinic anhydride and a polyamine, the polybutenylsuccinic anhydride being produced from polybutene and maleic anhydride by a thermal reaction method using neither chlorine or a chlorine atom-containing compound.

The metal-containing detergent in the lubricating oil composition of the present invention preferably is a non-sulfurized alkali metal or alkaline earth metal salt of an alkylsalicylic acid having a TBN of 30 to 300 mg·KOH/g, more preferably 30 to 100 mg·KOH/g. The metal-containing detergent is chosen and incorporated into the lubricating oil composition under the condition that the organic acid metal salt (i.e., soap content) originating from the metal-containing detergent is in an amount of 0.2 to 7 wt. %, more preferably 0.5 to 5 wt %, and most preferably 1 to 3 wt %.

The oxidation inhibitor preferably is a hindered phenol compound or a diarylamine compound, or a combination thereof.

The lubricating oil composition of the present invention preferably further contains a molybdenum-containing compound in an amount of 0.01 to 5 wt. %, an alkali metal borate hydrate in an amount of 0.01 to 5 wt. %, and, optionally, a viscosity index improver.

The mineral base oil preferably has an aromatic content of at most 5 wt. %, a nitrogen content of at most 0.005 wt. %, a sulfur content of at most 0.005 wt. %, and a viscosity index in the range of 100 to 150.

In another aspect, the present invention also resides in a method of lubricating a diesel engine with a lubricating oil composition of the present invention.

In still another aspect, the present invention also resides in a method of lubricating a diesel engine equipped with an exhaust gas after-treatment system comprising a particulate filter and an oxidizing catalyst composition and/or $NO_x$ reducing catalysts, using a lubricating oil composition of the present invention.

Among other things, it has now been discovered that the high temperature stability of a lubricating oil composition having a low sulfur content, a low phosphorus content, and a low sulfated ash content can be maintained by using a small amount of a metal-containing compound, namely a metal-containing detergent having a certain amount of soap content, in the lubricating oil composition. The lubricating composition of the present invention is useful in motor driven vehicles using low sulfur hydrocarbon fuels (0.01 wt. % or less), particularly diesel engine-mounted vehicles to which exhaust gas-cleaning devices containing particulate filters and oxidizing catalyst and/or $NO_x$ reducing catalyst are attached.

DETAILED DESCRIPTION OF THE INVENTION

In the lubricating oil composition of the present invention, the base oil is a mineral oil having a sulfur content of at most 0.1 wt. %, preferably at most 0.03 wt. %, most preferably at most 0.005 wt. %, and generally having a kinematic viscosity of 2 to 50 $mm^2/s$ at 100° C. The mineral base oil can be produced by processing a lubricating oil grade distillate by solvent refining and/or hydrotreating or hydrocracking.

A mineral base oil having a viscosity index of 100 to 150, an aromatic content of less than 5 wt. %, N- and S-content of less than 50 ppm, which can be obtained by hydrocracking is preferably employed for preparing the lubricating oil composition of the present invention.

The mineral base oil can be produced from slack wax or natural gas. The mineral base oil can be a known Shell XHVI (Extra High Viscosity Index) oil.

A portion (less than 50 wt. %) of the mineral base oil can be replaced with a synthetic oil. Examples of the synthetic oils include poly-α-olefins (e.g., polymers of α-olefins having 3 to 12 carbon atoms; dialkyl diesters which are di-($C_4$–$C_{18}$)alkyl esters of sebacic acid, azelaic acid, or adipic acid (typically, dioctyl sebacate); polyol esters derived from 1-trimethylolpropane or pentaerythritol and monobasic acids having 3 to 18 carbon atoms; and alkylbenzenes containing an alkyl group of 9 to 40 carbon atoms.

The lubricating oil composition of the present invention further contains an ashless dispersant which comprises an alkenyl- or alkyl-succinimide or a derivative thereof in an amount of 0.01 to 0.3 wt. % in terms of the nitrogen atom content. A representative succinimide can be prepared by the reaction of a high molecular weight alkenyl- or alkyl-substituted succinic anhydride and a polyalkylene polyamine having 4 to 10 nitrogen atoms (average value), preferably 5 to 7 nitrogen atoms (average value) per mole. The alkenyl or alkyl group of the alkenyl or alkyl succinimide compound is preferably derived from a polybutene having a molecular weight (in this specification, this means a number average molecular weight) of 900 to 3,000.

The reaction between polybutene and maleic anhydride for the preparation of polybutenyl succinic anhydride is generally performed by a chlorination process using chlorine. Accordingly, the resulting polybutenyl succinic anhydride as well as a polybutenyl succinimide produced from the polybutenyl succinic anhydride has a chlorine content in the range of approx. 2,000 to 3,000 ppm (wt). In contrast, a thermal process using no chlorine gives a polybutenyl succinic anhydride and a polybutenyl succinimide having a chlorine content in a range of such as less than 30 ppm (wt). Therefore, a succinimide derived from a succinic anhydride produced by the thermal process is preferred due to a smaller chlorine content in the lubricating oil composition.

The alkenyl- or alkyl-succinimide can be a modified alkenyl- or alkyl-succinimide which is obtained by after-treatment using a boric acid, an alcohol, an aldehyde, a ketone, an alkylphenol, a cyclic carbonate, an organic acid, or the like. Preferable modified succinimides are borated alkenyl- or alkyl-succinimides which are produced by after-treatment using boric acid or a boron-containing compound. The borated succinimides are preferred because of their high thermal and oxidation stability.

The lubricating oil composition of the present invention can further contain other ashless dispersants such as succinic acid ester dispersants and benzylamine dispersants.

The lubricating oil composition of the present invention further contains a metal-containing detergent which contains an organic acid metal salt component. Specifically, the metal-containing detergent may be one or a combination of a non-sulfurized alkali metal or alkaline earth metal salt of an alkylsalicylic acid having a TBN of 10 to 350 mg·KOH/g or a non-sulfurized alkali metal or alkaline earth metal salt of an alkylphenol derivative having a Mannich base structure. Preferably, the metal-containing detergent is a non-sulfurized alkali metal or alkaline earth metal salt of an alkylsalicylic acid having a TBN of 30 to 300 mg·KOH/g, more preferably 30 to 100 mg·KOH/g. The detergent is used in the lubricating oil composition in an amount of 0.1 to 1 wt. % in terms of the sulfated ash content.

The alkylsalicylate preferably employed in the present invention is an alkali metal salt or an alkaline earth metal salt of an alkylsalicylic acid which is prepared from an alkylphenol by Kolbe-Schmitt reaction. The alkylphenol is prepared by a reaction of α-olefin having approx. 8 to 30 carbon atoms (mean number) with phenol.

The alkaline earth metal salts such as Ca salt and Mg salt can be produced from Na salt or K salt by double decomposition or decomposition using sulfuric acid. The double decomposition using calcium chloride ($CaCl_2$) is not preferred, because chlorine is incorporated into the resulting salt.

Alternatively, calcium salicylate can be produced by direct neutralization of alkylphenol and subsequent carbonation. However, the conversion ratio is less than that of the Kolbe-Schmitt reaction.

Accordingly, a non-sulfurized alkylsalicylate having a TBN of 30 to 300 mg·KOH/g, preferably, 30 to 100 mg·KOH/g, which can be prepared by a series of Kolbe-Schmitt reactions and decomposition using sulfuric acid is most preferred for the use in the lubricating oil composition of the present invention.

In addition to the metal-containing detergent in the lubricating oil composition of the present invention, an alkali metal salt or an alkaline earth metal salt of an organic acid or phenol derivative having a carbon-nitrogen bonding is also preferred. Generally, a metal-containing detergent having been treated with an amine compound has a base number originating from the basic nitrogen component and hence it advantageously has a low ash but a high base number. For instance, there are exemplified various compounds such as metal salts of aminocarboxylic acids. Most preferred is a non-sulfurized alkylphenate (alkali metal salt or alkaline earth metal salt of alkylphenol derivative) having a Mannich base structure. This compound can be prepared by the following process: an alkylphenol, formaldehyde, and an amine or an amine compound are subjected to Mannich reaction; the phenol ring of the resulting compound is amino-methylated; and thus obtained product is neutralized with a base such as calcium hydroxide to give the desired metal salt. Particularly preferred is a compound of the following formula, in which R is an alkyl group having 8 to 30 carbon atoms, and n is 0 or a positive integer:

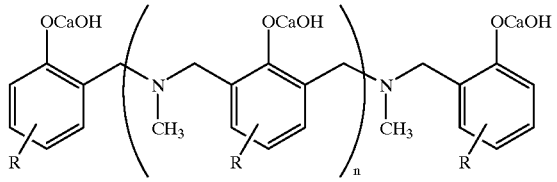

A representative compound of the above-mentioned formula can have 2.5 wt. % Ca, 1.6 wt. % N, and a TBN of 135 mg·KOH/g. This means that the base number originating from the nitrogen component amounts to approximately 50% of the total base number.

The non-sulfurized alkylsalicylate and the non-sulfurized alkylphenate having a Mannich base structure can be employed in combination.

Other metal-containing detergents such as sulfonate or phenate detergents can be employed in combination with the non-sulfurized alkylsalicylate and/or the non-sulfurized alkylphenate having a Mannich base structure.

The sulfonate detergents are alkali metal salts or alkaline earth metal salts of petroleum sulfonic acids or alkylbenzenesulfonic acids. Preferred is a sulfonate having a low TBN which has high stability at high temperatures but gives a relatively low sulfated ash content. A known phenate detergent such as alkali metal salts or alkaline earth metal salts of sulfurized alkylphenol would be employed within the limits of the sulfated ash or sulfur content of the lubricating oil composition of the present invention.

The metal-containing detergent in the lubricating oil composition of the present invention is generally available in the form of an oily dispersion which comprises a metal salt of an organic acid (generally referred to as "soap component") and particles of basic inorganic salts (e.g., calcium carbonate particles) gathering around the organic acid metal salt in a base oil. The high temperature detergency (that is, ability to keep the inside of engine clean at high temperatures) of a lubricating oil composition does not decrease when the content of the metal-containing detergent in the lubricating oil composition is decreased, provided that the organic acid metal salt (i.e., soap component) is contained in the lubricating oil composition at a certain level or more, i.e., 0.2 to 7 wt. %.

The lubricating oil composition of the present invention further contains a zinc dialkyldithiophosphate (i.e., Zn-DTP) in an amount of 0.01 to 0.1 wt. % in terms of the phosphorus content. More preferred is an amount of 0.01 to 0.06 wt. %.

The ZN-DTP preferably is zinc dihydrocarbyldithiophosphate containing an alkyl group of 3 to 18 carbon atoms or an alkylaryl group having an alkyl group of 3 to 18 carbon atoms. Particularly preferred is a Zn-DTP having an alkyl group derived from a secondary alcohol of 3 to 18 carbon atoms or a mixture of the secondary alcohol and a primary alcohol. The primary alcohol has a property of high heat resistance.

The lubricating oil composition of the present invention further contains an oxidation inhibitor selected from the group consisting of phenol compounds and amine compounds in an amount of 0.01 to 5 wt. %, more preferably 0.1 to 3 wt. %. Generally, a lubricating oil composition having a low sulfated ash content, a low phosphorus content, and a low sulfur content shows low detergency at high temperatures, low oxidation stability and low wear-resistance due to decreases of amounts of a metal-containing detergent and a zinc dithiophosphate. In order to compensate the decreased detergency, oxidation stability and wear-resistance, a hindered phenol oxidation inhibitor and/or a diarylamine oxidation inhibitor are favorably used. The diarylamine oxidation inhibitor advantageously gives a base number originating from the nitrogen component, while the hindered phenol oxidation inhibitor advantageously shows inhibition of oil deterioration caused by oxidation in the presence of $NO_x$.

Examples of the hindered phenol compounds include 2,6-di-t-butyl-p-cresol, 4,4'-methylenebis(2,6-di-t-butylphenol), 4,4'-methylenebis(6-t-butyl-o-cresol), 4,4'-thiobis(2-methyl-6-t-butylphenol), 4,4'-isopropylidenebis(2,6-di-t-butylphenol), 4,4'-bis(2,6-di-t-butylphenol), 2,2'-methylenebis(4-methyl-6-t-butylphenol), 4,4'-thiobis(2-methyl-6-t-butylphenol), 2,2-thiodiethylenebis[3-(3,5-d 1-t-butyl-4-hydroxyphenyl)propionate], octyl 3-(3,5-d 1-t-butyl-4-hydroxyphenyl)propionate, and octadecyl 3-(3,5-di-t-butyl-4-hydroxyphenyl)propionate.

Examples of the diarylamine compounds include an alkyldiphenylamine containing a mixture of alkyl groups having 4 to 9 carbon atoms, p,p'-dioctyidiphenylamine, phenyl-α-naphthylamine, phenyl-β-naphthylamine, alkylated α-naphthylamine, and alkylated phenyl-α-naphthylamine. Each of the hindered phenol compound and diarylamine compounds can be employed singly or in combination. Other oil soluble oxidation inhibitors can be employed in combination.

The lubricating oil composition of the present invention preferably further contains a molybdenum compound and/or a hydrated alkali metal borate in an amount of not more than 5 wt. %, particularly, 0.01 to 5.0 wt. %, for each compound. These compounds give sulfated ash and may have a sulfur content. Accordingly, the amounts of these compounds are controlled in view of the various component contents and the desired characteristics.

The molybdenum compound functions as a friction modifier, an oxidation inhibitor and/or an anti-wear agent in the lubricating oil composition of the present invention, and further imparts increased high temperature detergency to the lubricating oil composition. The content of the molybdenum compound in the lubricating oil composition preferably is in an amount of 10 to 2,500 ppm in terms of molybdenum element. Examples of the molybdenum compounds include a sulfur-containing oxymolybdenum succinicimide complex compound (described in Japanese Patent Publication No. 3-22438), an oxymolybdenum dithiocarbamate sulfide, oxymolybdenum dithiophosphate sulfide, amine-molybdenum complex compound, oxymolybdenum diethylate amide, and oxymolybdenum monoglyceride. Particularly, the sulfur-containing oxymolybdenum succinic imide complex compound is effective for increasing the high temperature detergency.

The addition of a hydrated alkali metal borate is also effective for imparting high temperature detergency and adding a base number to the lubricating oil composition. Preparation of typical hydrated alkali metal borates is described in U.S. Pat. Nos. 3,929,650 and 4,089,790. For instance, the hydrated alkali metal borate can be prepared by the steps of carbonation of neutral alkali metal or alkaline earth metal sulfonate in the presence of an alkali metal hydroxide to give over-based sulfonate; and causing thus obtained sulfonate to react with boric acid so as to produce micro-particles of an alkali metal borate dispersed in the resulting reaction mixture. For the carbonation reaction, an ashless dispersant such as succinimide is preferably present in the reaction mixture. The alkali metal preferably is potassium or sodium. Particularly preferred is a dispersion of micro-particles (particle size: less than approx. 0.3 μm) of $KB_3O_5.H_2O$ in a succinimide-containing oil. The corresponding salt in which K is replaced with Na is also advantageously employed from the viewpoint of resistance to hydrolysis.

The lubricating oil composition of the present invention preferably further contains a viscosity index improver in an amount of not more than 20 wt. %, preferably 1 to 20 wt. %. Examples of the viscosity index improvers include polyalkyl methacrylate, ethylene-propylene copolymer, styrene-butadiene copolymer, and polyisoprene. The viscosity index improvers can be of a dispersant type or a multi-functional type. The viscosity index improvers can be employed singly or in combination.

The lubricating oil composition of the present invention may further contain other auxiliary additives. Examples of other auxiliary additives include zinc dithiocarbamate, methylenebis(dibutyldithiocarbamate), oil soluble copper compounds, sulfur-containing compounds (e.g., olefin sulfide, ester sulfide, and polysulfide), phosphoric acid esters, phosphorous acid esters, and organic amide compounds (e.g., oleylamide) which serve as oxidation inhibitors and anti-wear agents. The examples may further include metal-inactivating agents (e.g., benzotriazole compounds and thiadiazole compounds), anti-rust agents or anti-emulsifiers (e.g., nonionic polyoxyalkylene surfactants such as polyoxyethylene alkylphenyl ether, copolymer of ethylene oxide and propylene oxide), friction modifiers (e.g., amine compounds, amide compounds, amine salts, their derivatives, fatty acid esters of polyhydric alcohols, their derivatives), anti-foaming agents, and pour point depressants. Each of these auxiliary additives can be incorporated into the lubricating oil composition in an amount of not more than 3 wt. %, preferably 0.001 to 3 wt. %.

EXAMPLES

The invention will be further illustrated by the following examples, which set forth particularly advantageous embodiments. While the Examples are provided to illustrate the present invention, they are not intended to limit it. This application is intended to cover those various changes and substitutions that may be made by those skilled in the art without departing from the spirit and scope of the appended claims.

Preparation of Lubricating Oil Composition

Lubricating oil compositions of the present invention and lubricating oil compositions for comparison were prepared employing the below-mentioned components. The lubricating oil compositions were adjusted to give a 10W30 oil (SAE viscosity grade) by the addition of viscosity index improver.

Additive Components and Base Oils

Dispersant-A:

Succinimide-type dispersant (nitrogen content: 1.6 wt. %, chlorine content: <5 ppm (wt)) prepared by thermal reaction process using polybutene of a number-average molecular weight of approx. 1,300 and maleic anhydride and by the reaction with polyalkylene polyamine having a mean nitrogen atom number of 6.5 (per one molecule)

Dispersant-B:

Borated succinimide-type dispersant (nitrogen content: 1.5 wt. %, boron content: 0.5 wt. %, chlorine content: <5 ppm (wt)) prepared by thermal reaction process using polybutene of a number-average molecular weight of approx. 1,300 and maleic anhydride, by the reaction with polyalkylene polyamine having a mean nitrogen atom number of 6.5 (per one molecule), and by the treatment of the resulting succinimide with boric acid, according to Example No. 8 of U.S. Pat. No. 5,356,552.

Dispersant-C:

Ethylene carbonate-treated succinimide-type dispersant (nitrogen content: 0.85 wt. %, chlorine content: 30 ppm (wt)) prepared by the thermal reaction process using polybutene of a number-average molecular weight of approx. 2,200 and maleic anhydride, by the reaction with polyalkylene polyamine having a mean nitrogen atom number of 6.5 (per one molecule), and by the treatment of the resulting succinimide with ethylene carbonate, according to Example No. 17 of U.S. Pat. No. 5,356,552.

Detergent A:

Calcium salicylate (2.1 wt. % Ca, 0.13 wt. % S, TBN: 60 mg·KOH/g, OSCA 431B available from OSCA Chemical Co., Ltd.)

Detergent B:

Calcium salicylate (8.2 wt. % Ca, 0.13 wt. % S, TBN: 230 mg·KOH/g, OSCA 435B available from OSCA Chemical Co., Ltd.)

Detergent C:

Magnesium salicylate (6.0 wt. % Mg, 0.22 wt. % S, TBN: 280 mg·KOH/g, SAP 008 available from Shell Japan Co., Ltd.)

Detergent D:

Calcium sulfonate (2.4 wt. % Ca, 2.9 wt. % S, TBN: 17 mg·KOH/g, OLOA 246S available from Oronite Japan Ltd.)

Detergent E:

Calcium sulfonate (12.8 wt. % Ca, 2.0 wt. % S, TBN: 325 mg·KOH/g, OLOA 247Z available from Oronite Japan Ltd.)

Detergent F:

Calcium sulfonate (15.5 wt. % Ca, 1.6 wt. % S, TBN: 410 mg·KOH/g, OLOA 249S available from Oronite Japan Ltd.)

Detergent G:

Sulfurized calcium phenate (4.3 wt. % Ca, 5.5 wt. % S, TBN: 120 mg·KOH/g, OLOA 216Q available from Oronite Japan Ltd.)

Detergent H:

Sulfurized calcium phenate (9.3 wt. % Ca, 3.4 wt. % S, TBN: 255 mg·KOH/g, OLOA 219 available from Oronite Japan Ltd.)

Detergent I:

Mannich base-containing calcium phenate (2.5 wt. % Ca, 1.6 wt. % N, 0.1 wt. % S, TBN: 135 mg·KOH/g, OLOA 224 available from Oronite Japan Ltd.)

Zn-DTP:

Zinc dialkyldithiophosphate (7.2 wt. % P, 7.85 wt. % Zn, 14.4 wt. % S) prepared using secondary alcohol of 3 to 8 carbon atoms Oxidation Inhibitor A:

Amine compound [dialkyldiphenylamine, alkyl moiety: mixture of $C_4$ alkyl and $C_8$ alkyl, 4.6 wt. % N, TBN: 180 mg·KOH/g]

Oxidation Inhibitor B:

Phenol compound [octyl 3-(3,5-di-t-butyl-4-hydroxyphenyl)propionate]

Mo Compound:

Sulfur-containing oxymolybdenum-succinimide complex compound (5.4 wt. % Mo, 3.7 wt. % S, TBN: 45 mg·KOH/g)

Alkali Metal Borate:

Dispersion of micro particles of hydrated potassium borate (experimental formula: $KB_3O_5.H_2O$, 8.3 wt. % K, 6.8 wt. % B, 0.26 wt. % S, TBN: 125 mg·KOH/g)

V.I.I.:

Viscosity index improver of ethylene-propylene copolymer (non-dispersant type, Paratone 8057)

P.P.D.:

pour point depressant of polymethacrylate type

Base Oil A:

Hydrocracked oil (kinematic viscosity: 6.5 $mm^2/s$ at 100° C., viscosity index: 132, <0.001 wt. % S)

Base Oil B:

Hydrocracked oil (kinematic viscosity: 11.0 $mm^2/s$ at 100° C., viscosity index: 104, <0.001 wt. % S)

Base Oil C:

Solvent refined oil (kinematic viscosity: 5.3 $mm^2/s$ at 100° C., viscosity index: 101, 0.21 wt. % S)

Test Procedures

1) Measurement of Organic Acid Metal Salt Content (Soap Content)

The mineral oil portion and low molecular weight compounds in the metal-containing detergent are removed by the conventional rubber membrane dialysis. The residue (A) remaining in the membrane is weighed. Separately, the content of carbon dioxide originating from carbonate in the metal-containing detergent is measured, and the quantitative analysis of metal elements is carried out. From the carbon dioxide content and the metal content, the amount (B) of over-base components such as calcium carbonate or magnesium carbonate is calculated. The soap content (namely, organic acid metal salt content) is calculated by deducing (B) from (A).

2) Hot Tube Test (KES-07-803) for Evaluating Detergency at High Temperatures

In a heater block, a glass tube having an inner diameter of 2 mm is vertically set. The test oil composition and air are introduced into the glass tube from its lower end at rates of 0.31 cc/hr. and 10 cc/min., respectively, at 290° C. or 300° C. (temperature of the heater) for 16 hours. Subsequently, the deposit produced on the glass tube is visually evaluated to mark the lacquer formation on the basis of 10 points. A higher value means that the lacquer is less and the detergency is better.

Example 1

A lubricating oil composition (TBN: 7.0 mg·KOH/g) of the present invention was prepared in accordance with the following formulation:

(1) Ashless dispersant

Dispersant B: 4 wt. % (amount in terms of N content: 0.06 wt. %)

Dispersant C: 1.2 wt. % (amount in terms of N content: 0.01 wt. %)

(2) Metal-containing detergent

Detergent A: 6.9 wt. % (amount in terms of sulfated ash content: 0.49 wt %)

(3) Zn DTP: 0.42 wt. % (amount in terms of P content: 0.03 wt. %)

(4) Oxidation Inhibitor

Oxidation Inhibitor A: 0.7 wt. %

Oxidation Inhibitor B: 0.7 wt. %

(5) Other additives

Mo compound: 0.1 wt. %

Alkali metal borate: 0 wt. %

Viscosity Index Improver: 2.0 wt. %

Pour Point Depressant: 0.3 wt. %

(6) Base oil

Base oil A: 62.4 wt. %

Base oil B: 20.8 wt. %

(7) Soap content originating from the Detergent: 2.5 wt. %

Example 2

A lubricating oil composition (TBN: 6.9 mg·KOH/g) of the present invention was prepared in accordance with the formulation of Example 1 except that the following changes were made:

(2) Metal-containing detergent

Detergent B: 1.8 wt. % (amount in terms of sulfated ash content: 0.49 wt. %)

(6) Base oil

Base oil A: 66.4 wt. %

Base oil B: 22.2 wt. %

(7) Soap content originating from the Detergent: 0.7 wt. %

Example 3

A lubricating oil composition (TBN: 7.5 mg·KOH/g) of the present invention was prepared in accordance with the formulation of Example 1 except that the following changes were made:

(2) Metal-containing detergent

Detergent C; 1.7 wt. % (amount in terms of sulfated ash content: 0.49 wt. %)

(6) Base oil

Base oil A: 66.8 wt. %

Base oil B: 22.3 wt. %

(7) Soap content originating from the Detergent: 0.4 wt. %

Example 4

A lubricating oil composition (TBN: 14.7 mg·KOH/g) of the present invention was prepared in accordance with the formulation of Example 1 except that the following changes were made:

(2) Metal-containing detergent

Detergent I: 5.8 wt. % (amount in terms of sulfated ash content: 0.49 wt. %)

(6) Base oil

Base oil A: 63.3 wt. %

Base oil B: 21.1 wt. %

(7) Soap content originating from the Detergent: 2.3 wt. %

Example 5

A lubricating oil composition (TBN: 7.5 mg·KOH/g) of the present invention was prepared in accordance with the formulation of Example 1 except that the following changes were made:

(2) Metal-containing detergent

Detergent A: 5.9 wt. % (amount in terms of sulfated ash content: 0.42 wt. %)

Detergent I: 0.82 wt. % (amount in terms of sulfated ash content: 0.07 wt. %)

(6) Base oil

Base oil A: 62.5 wt. %

Base oil B: 20.9 wt. %

(7) Soap content originating from the Detergents: 2.1 wt. %+0.3 wt. %, respectively)

Example 6

A lubricating oil composition (TBN: 6.9 mg·KOH/g) of the present invention was prepared in accordance with the formulation of Example 1 except that the following changes were made:

(2) Metal-containing detergent

Detergent A: 5.9 wt. % (amount in terms of sulfated ash content: 0.42 wt. %)

Detergent G: 0.49 wt. % (amount in terms of sulfated ash content: 0.07 wt. %)

(6) Base oil

Base oil A: 62.8 wt. %

Base oil B: 20.9 wt. %

(7) Soap content originating from the Detergents: 2.1 wt. %+0.2 wt. %, respectively)

Example 7

A lubricating oil composition (TBN: 6.5 mg·KOH/g) of the present invention was prepared in accordance with the formulation of Example 1 except that the following changes were made:

(2) Metal-containing detergent

Detergent A: 5.9 wt. % (amount in terms of sulfated ash content: 0.42 wt. %)

Detergent D: 0.88 wt. % (amount in terms of sulfated ash content: 0.07 wt. %)

(6) Base oil

Base oil A: 62.5 wt. %

Base oil B: 20.8 wt. %

(7) Soap content originating from the Detergents: 2.1 wt. %+0.4 wt. %, respectively)

Example 8

A lubricating oil composition (TBN: 7.0 mg·KOH/g) of the present invention was prepared in accordance with the formulation of Example 1 except that the following changes were made:

Mo compound: 0.2 wt. %

(6) Base oil

Base oil A: 62.3 wt. %

Base oil B: 20.8 wt. %

Example 9

A lubricating oil composition (TBN: 7.3 mg·KOH/g) of the present invention was prepared in accordance with the formulation of Example 1 except that the following changes were made:

The alkali metal borate was added in an amount of 0.3 wt. %;

(6) Base oil

Base oil A: 62.2 wt. %

Base oil B: 20.7 wt. %

Example 10

A lubricating oil composition (TBN: 7.3 mg·KOH/g) of the present invention was prepared in accordance with the formulation of Example 1 except that the following changes were made:

(1) Ashless dispersant

Dispersant A: 4 wt. % (amount in terms of N content: 0.06 wt. %)

Dispersant C: 1.2 wt. % (amount in terms of N content: 0.01 wt. %)

(6) Base oil

Base oil A: 62.2 wt. %

Base oil B: 20.7 wt. %

Comparative Example A

A lubricating oil composition (TBN: 6.6 mg·KOH/g) for comparison was prepared in accordance with the formulation of Example 1 except that the following changes were made:

(2) Metal-containing detergent

Detergent F: 0.93 wt. % (amount in terms of sulfated ash content: 0.49 wt %)

(6) Base oil

Base oil A: 67.1 wt. %

Base oil B: 22.4 wt. %

(7) Soap originating from the Detergent: 0.1 wt. %

Comparative Example B

A lubricating oil composition (TBN: 13.0 mg·KOH/g) for comparison (high sulfated ash content, high phosphorus content, high sulfur content) was prepared in accordance with the formulation of Example 1 except that the following changes were made:

(1) Ashless dispersant

Dispersant B: 2.8 wt. % (amount in terms of N content: 0.04 wt. %)

Dispersant C: 2.4 wt. % (amount in terms of N content: 0.02 wt. %)

(2) Metal-containing detergent

Detergent D: 1.8 wt. % (amount in terms of sulfated ash content: 0.14 wt. %)

Detergent H: 4.6 wt. % (amount in terms of sulfated ash content: 1.43 wt. %)

(3) Zn DTP: amount in terms of P content: 0.12 wt. %

VII: 5.2 wt. %

(6) Base oil

Base oil C: 82.4 wt. %

(7) Soap content originating from the Detergents: 0.8 wt. %+1.8 wt. %, respectively Comparative Example C A lubricating oil composition (TBN: 12.8 mg·KOH/g) for comparison (high sulfated ash content, high phosphorus content, high sulfur content) was prepared in accordance with the formulation of Comparative Example B except that the following changes were made:

(2) Metal-containing detergent

Detergent D: 1.8 wt. % (amount in terms of sulfated ash content: 0.14 wt. %)

Detergent E: 1.1 wt. % (amount in terms of sulfated ash content: 0.48 wt. %)

Detergent H: 3.0 wt. % (amount in terms of sulfated ash content: 0.95 wt. %)

(6) Base oil

Base oil C: 81.9 wt. %

(7) Soap content originating from the Detergents: 0.8 wt. %+0.2 wt. %+1.2 wt. %, respectively Comparative Example D A commercially available representative lubricating oil composition (TBN: 12.1 mg·KOH/g, SAE 10W30, API-CF) for diesel engine was purchased and subjected to the same evaluation.

The results of these evaluations are set forth in the following Table.

TABLE

| Example No. | Ash (wt. %) | P (wt. %) | S (wt. %) | Cl (ppm) | Soap (wt. %) | Hot Tube Test 290° C. | Hot Tube Test 300° C. |
|---|---|---|---|---|---|---|---|
| Ex. 1 | 0.6 | 0.03 | 0.08 | <5 | 2.5 | 8.5 | 4.5 |
| Ex. 2 | 0.6 | 0.03 | 0.07 | <5 | 0.7 | 7.0 | 3.5 |
| Ex. 3 | 0.6 | 0.03 | 0.07 | <5 | 0.4 | 7.0 | 6.0 |
| Ex. 4 | 0.6 | 0.03 | 0.08 | <5 | 2.3 | 8.5 | 5.5 |
| Ex. 5 | 0.6 | 0.03 | 0.08 | <5 | 2.4 | 8.5 | 6.0 |
| Ex. 6 | 0.6 | 0.03 | 0.11 | <5 | 2.3 | 8.5 | 5.5 |
| Ex. 7 | 0.6 | 0.03 | 0.10 | 10 | 2.5 | 8.5 | 6.0 |
| Ex. 8 | 0.6 | 0.03 | 0.08 | <5 | 2.5 | 8.5 | 6.0 |
| Ex. 9 | 0.65 | 0.03 | 0.08 | <5 | 2.5 | 9.0 | 8.5 |
| Ex. 10 | 0.65 | 0.03 | 0.08 | <5 | 2.5 | 8.0 | 7.0 |
| Com. A | 0.6 | 0.03 | 0.08 | <5 | 0.1 | 5.5 | 3.0 |
| Com. B | 1.8 | 0.12 | 0.65 | 20 | 2.6 | 7.0 | 6.0 |
| Com. C | 1.8 | 0.12 | 0.62 | 20 | 2.2 | 6.5 | 6.5 |
| Com. D | 1.7 | 0.11 | 0.54 | 120 | — | 7.5 | 6.0 |

The test results set forth in the above Table clearly indicate that the lubricating oil compositions of the present invention (Examples 1 to 10) despite having a low sulfated ash content, a low phosphorus content, and a low sulfur content, nevertheless, provide high temperature detergency at the same level as or superior to the conventionally employed diesel engine-lubricating oils (Comparative Examples B to D) having a high sulfated ash content, a high phosphorus content, and a high sulfur content. The lubricating oil composition of Comparative Example A employing a high TBN calcium sulfonate as the metal-containing detergent and having a low soap content is inferior in the high temperature detergency.

What is claimed is:

1. A lubricating oil composition having a sulfur content of 0.01 to 0.3 wt. %, a phosphorus content of 0.01 to 0.1 wt. %, and giving a sulfated ash in the range of 0.1 to 1 wt. % and an organic acid metal salt content in the range of 0.2 to 7 wt. %, which comprises a) a major amount of a mineral base oil having a sulfur content of at most 0.1 wt. %;

b) an ashless dispersant comprising an alkenyl- or alkylsuccinimide or a derivative thereof in an amount of 0.01 to 0.3 wt. % in terms of a nitrogen atom content;

c) a metal-containing detergent containing an organic acid metal salt which is selected from the group consisting of a non-sulfurized alkali metal or alkaline earth metal salt of an alkylsalicylic acid having a TBN of 10 to 350 mgKOH/g and a non-sulfurized alkali metal or alkaline earth metal salt of an alkylphenol derivative having a Mannich base structure, in an amount of 0.1 to 1 wt. % in terms of a sulfated ash content;

d) a zinc dialkyldithiophosphate in an amount of 0.01 to 0.1 wt. % in terms of a phosphorus content; and e) an oxidation inhibitor selected from the group consisting of a phenol compound and an amine compound in an amount of 0.01 to 5 wt. %.

2. The lubricating oil composition of claim 1, which has a sulfur content of 0.01 to 0.15 wt. %.

3. The lubricating oil composition of claim 1, which has a phosphorus content of 0.01 to 0.06 wt. %.

4. The lubricating oil composition of claim 1, which has a chlorine content of at most 40 ppm.

5. The lubricating oil composition of claim 4, in which the ashless dispersant has a chlorine content of at most 30 ppm.

6. The lubricating oil composition of claim 5, in which the ashless dispersant is a succinimide or a derivative thereof which is obtained by the reaction of a polybutenylsuccinic anhydride and a polyamine, the polybutenylsuccinic anhydride being produced from polybutene and maleic anhydride by a thermal reaction method using neither chlorine or a chlorine atom-containing compound.

7. The lubricating oil composition of claim 1, in which the metal-containing detergent is a non-sulfurized alkali metal or alkaline earth metal salt of an alkylsalicylic acid having a TBN of 30 to 300 mg·KOH/g.

8. The lubricating oil composition of claim 7, in which the metal-containing detergent is a non-sulfurized alkali metal or alkaline earth metal salt of an alkylsalicylic acid having a TBN of 30 to 100 mg·KOH/g.

9. The lubricating oil composition of claim 1, in which the oxidation inhibitor is a hindered phenol compound or a diarylamine compound.

10. The lubricating oil composition of claim 1, in which the oxidation inhibitor is a combination of a hindered phenol compound or a diarylamine compound.

11. The lubricating oil composition of claim 1, which further contains a molybdenum-containing compound in an amount of 0.01 to 5 wt. %.

12. The lubricating oil composition of claim 1, in which the oxidation inhibitor is a combination of a hindered phenol compound and a diarylamine compound, and which further contains a molybdenum-containing compound in an amount of 0.01 to 5 wt. %.

13. The lubricating oil composition of claim 1, which further contains an alkali metal borate hydrate in an amount of 0.01 to 5 wt. %.

14. The lubricating oil composition of claim 1, which further contains a viscosity index improver.

15. The lubricating oil composition of claim 1, in which the mineral base oil is a hydrocracked mineral oil having a sulfur content of at most 0.03 wt. %.

16. The lubricating oil composition of claim 15, in which the mineral base oil has a sulfur content of at most 0.005 wt. %.

17. The lubricating oil composition of claim 16, in which the mineral base oil has an aromatic component content of at most 5 wt. %, a nitrogen content of at most 50 ppm, a sulfur content of at most of 50 ppm, and a viscosity index in the range of 100 to 150.

18. A method of lubricating a diesel engine with a lubricating oil composition of claim 1.

19. A method of lubricating a diesel engine equipped with an exhaust gas after-treatment system comprising a particulate filter and an oxidizing catalyst or a $NO_x$ reducing catalyst composition, using a lubricating oil composition of claim 1.

* * * * *